United States Patent [19]

Tabei et al.

[11] Patent Number: 4,472,213

[45] Date of Patent: Sep. 18, 1984

[54] COPPER-BASE SHAPE-MEMORY ALLOYS

[75] Inventors: Kazuhiko Tabei; Masafumi Hatsushika, both of Saitama, Japan

[73] Assignee: Mitsubishi Kinzoku Kabushiki Kaisha, Tokyo, Japan

[21] Appl. No.: 515,685

[22] Filed: Jul. 20, 1983

[30] Foreign Application Priority Data

Jul. 26, 1982 [JP] Japan ..... 57-130071

[51] Int. Cl.[3] ..... C22C 9/01; C22C 9/04

[52] U.S. Cl. ..... 148/402; 420/478

[58] Field of Search ..... 148/402, 413, 434; 420/478

[56] References Cited

U.S. PATENT DOCUMENTS 3,703,367 11/1972 Cocks ..... 148/413

4,274,872 6/1981 Melton et al. ..... 148/402

FOREIGN PATENT DOCUMENTS 71295 2/1983 European Pat. Off. ..... 148/402

56-87643 7/1981 Japan ..... 420/478

57-76143 5/1982 Japan ..... 148/434

57-123944 8/1982 Japan ..... 148/402

*Primary Examiner*—Peter K. Skiff

*Attorney, Agent, or Firm*—Browdy and Neimark

[57] ABSTRACT

A copper-base shape-memory alloy having high resistance to fatigue failure as well as high ductility and, in particular, high deformability in the martensite phase is disclosed. The alloy consists essentially of 10–45% Zn, 1–10% Al, 0.05–2% Ti, 0.05–2% of one of Fe and Ni, the balance being Cu and incidental impurities, the percent being by weight.

3 Claims, No Drawings

COPPER-BASE SHAPE-MEMORY ALLOYS

FIELD OF THE ART

The present invention relates to copper-base shape-memory alloys having high resistance to fatigue failure as well as high ductility and, in particular, high deformability in the martensite phase.

BACKGROUND OF THE ART

The shape-memory effect of shape-memory alloys occurs due to the transition from the beta phase at high temperatures to the thermoelastic martensite phase at low temperatures. The effect is either irreversible or reversible. Applications which use the irreversible shape-memory effect are found in connectors and couplings, and those which utilize the reversible effect are in window openers, valve switches, heat-actuated water sprinklers and safety switches, as well as thermodriven apparatus such as heat engines.

Typical shape-memory alloys that could be used commercially in the above mentioned applications are Cu-Zn-Al alloys consisting essentially of 10–45% Zn and 1–10% Al, the balance being Cu and incidental impurities (hereunder all percents are by weight). However, these copper-base shape-memory alloys are not highly reliable because they have low ductility both at high temperatures (beta-phase) and at low temperatures (martensite phase) and hence are prone to fatigue failure. The low ductility of the martensite phase results in its low deformability. However, the shape-memory effect of shape-memory alloys consists of deformation in the martensite phase at low temperatures and recovery to the original shape in the beta-phase at elevated temperatures, and therefore, the performance of shape-memory alloys largely depends on the deformability of the martensite phase. If the deformability of the martensite phase is low, the recovery to the original shape is reduced, and the desired working amount is not obtainable. This has been a limiting factor in the design of industrial devices using Cu-base shape-memory alloys.

SUMMARY

Various studies have therefore now been made in order to provide the conventional Cu-base shape-memory alloys with improved ductility and resistance to fatigue failure, as well as increased deformability of the martensite phase (this is hereunder simply referred to as deformability). As a result, it has now been found that this object can be attained by additionally incorporating Ti and one of Fe and Ni in the conventional Cu-base shape-memory alloy so as to form a structure wherein the grains of an intermetallic compound mainly consisting of Ti-Fe or Ti-Ni are uniformly dispersed in the matrix. This intermetallic compound is thermally very stable and will not form a solid solution in the matrix even if it is heated to as high as 900° C. Furthermore, the phase transition of the alloy remains stable even if it is subjected to varying heating and machining conditions. Therefore, the alloy exhibits increased deformability, and at the same time, it ensures improved resistance to fatigue failure on account of the presence of the intermetallic compound.

The present invention has been accomplished on the basis of this finding and relates to a copper-base shape-memory alloy consisting essentially of 10–45% Zn, 1–10% Al, 0.05–2% Ti and 0.05–2% of Fe or Ni, the balance being Cu and incidental impurities.

DESCRIPTION OF EMBODIMENTS

The criticality of the amount of each component of the alloy according to the present invention is stated as follows.

(a) Zn and Al

These elements are necessary for obtaining the shape-memory effect. This effect is not achieved if the Zn content is less than 10% and the Al content is less than 1%. Aluminum is also effective in controlling the deformation of the martensite phase and preventing the loss of zinc at elevated temperatures. This is another reason why aluminum must be present in an amount of 1% or more. If more than 45% of zinc and more than 10% of aluminum are contained in the alloy, it becomes brittle. Therefore, the contents of zinc and Al are specified in the amounts of 10–45% and 1–10%, respectively.

(b) Ti, Fe, and Ni

Ti combines with one of Fe or Ni to form an intermetallic compound having Ti-(Fe or Ni,) as primary components. The grains of this intermetallic compound are uniformly dispersed in the matrix of the alloy. In addition, this intermetallic compound is thermally very stable. Therefore, the alloy is provided with improved ductility, resistance to fatigue failure and deformability. If the content of each of titanium and the iron or nickel is less than 0.05%, the amount of the crystallizing intermetallic compound is not sufficient to bring about its advantages. If the content of each of titanium, iron group and nickel 2%, too much intermetallic compound is formed and the ductility of the martensite phase is reduced. Therefore, according to the present invention, the content of each of Ti, Fe or Ni is specified to be in the range of 0.05 to 2%.

The advantages of the alloy of the present invention are hereunder described by reference to a working example.

EXAMPLE

Twelve alloy samples of the present invention and three comparative samples having the compositions indicated in Table 1 were prepared by air melting in a high-frequency induction heating furnace from a mixture of electrolytic copper, electrolytic zinc, 99.99% pure aluminum, pure titanium, Cu-Fe mother alloy (30% Fe) and electrolytic nickel. Each alloy was cast to an ingot which was hot-forged and hot-rolled into two sheets, one having a thickness of 15 mm and other having a thickness of 1 mm. Each sheet was held at between 600° and 900° C. for one hour and water-quenched.

From each sheet having a thickness of 15 mm, cylindrical test pieces having a diameter of 4.5 mm were prepared and subjected to a rotary bending fatigue test at room temperature. Each test piece had the beta-structure at room temperature. From each sheet having a thickness, of 1 mm, test pieces measuring 3 mm wide, 300 mm long and 1 mm thick were prepared. After cooling them to the martensite phase, the test pieces were subjected to a 180° bending test using round bars of different diameters. In the rotary bending fatigue test, the time strength for $10^6$ bendings and the number of bendings the test pieces received until they failed at a load of 9 kg/mm$^2$ were measured. In the 180° bending test, the diameter of the least thick bar, around which each test piece could be bent over itself without developing cracks, was measured. The results of the two tests are shown in Table 1.

TABLE 1

| Alloy Sample No. | | Composition (wt %) Zn | Al | Ti | Fe | Ni | Co | Cu | rotary-bending test time strength (Kg/mm²) | number of bendings to cause failure | 180° bending test $D_{min.}$ (mm) |
|---|---|---|---|---|---|---|---|---|---|---|---|
| Alloys of the present invention | 1 | 11.5 | 9.8 | 0.90 | 0.83 | — | — | bal. | 20 | survived $10^7$ bendings | 12 |
| | 2 | 21.3 | 6.4 | 0.89 | 0.92 | — | — | bal. | 24 | survived $10^7$ bendings | 10 |
| | 3 | 36.1 | 1.2 | 0.99 | 0.85 | — | — | bal. | 23 | survived $10^7$ bendings | 8 |
| | 4 | 13.0 | 9.5 | 1.01 | 0.83 | — | — | bal. | 21 | survived $10^7$ bendings | 12 |
| | 5 | 28.0 | 4.1 | 0.054 | 0.89 | — | — | bal. | 22 | survived $10^7$ bendings | 8 |
| | 6 | 21.0 | 6.0 | 1.89 | 0.91 | — | — | bal. | 24 | survived $10^7$ bendings | 12 |
| | 7 | 21.4 | 6.2 | 0.10 | 0.056 | — | — | bal. | 19 | survived $10^7$ bendings | 8 |
| | 8 | 21.8 | 6.4 | 0.48 | 0.51 | — | — | bal. | 23 | survived $10^7$ bendings | 8 |
| | 9 | 22.0 | 6.2 | 1.60 | 1.82 | — | — | bal. | 24 | survived $10^7$ bendings | 10 |
| | 10 | 21.4 | 6.0 | 0.06 | — | 0.059 | — | bal. | 20 | survived $10^7$ bendings | 10 |
| | 11 | 21.5 | 6.3 | 1.02 | — | 0.98 | — | bal. | 24 | survived $10^7$ bendings | 10 |
| | 12 | 21.2 | 6.3 | 1.02 | — | 1.97 | — | bal. | 25 | survived $10^7$ bendings | 12 |
| | 13 | 21.5 | 6.2 | 0.99 | 0.50 | 0.43 | — | bal. | 24 | survived $10^7$ bendings | 10 |
| Comparative Alloys | 14 | 21.3 | 6.5 | 1.62 | — | — | 1.88 | bal. | 25 | survived $10^7$ bendings | 12 |
| | 15 | 21.2 | 6.1 | 0.10 | — | — | 0.053 | bal. | 22 | survived $10^7$ bendings | 10 |
| | 16 | 21.4 | 6.4 | 1.03 | — | 0.61 | 0.33 | bal. | 23 | survived $10^7$ bendings | 10 |
| | 17 | 21.2 | 6.4 | 1.12 | 0.38 | 0.31 | 0.34 | bal. | 23 | survived $10^7$ bendings | 10 |
| | 18 | 21.9 | 6.2 | — | — | — | — | bal. | 15 | $2.90 \times 10^6$ | 16 |
| | 19 | 17.0 | 8.0 | — | — | — | — | bal. | 12 | $1.56 \times 10^6$ | 18 |
| | 20 | 11.5 | 10.1 | — | — | — | — | bal. | 11 | $1.30 \times 10^6$ | 24 |

Table 1 shows that alloy samples Nos. 1 to 13 of the present invention had high ductility, high resistance to fatigue failure and good deformability. However, comparative samples Nos. 18 to 20 that did not contain any of Ti, Fe and Ni were inferior to sample Nos. 1 to 13 in each of these characteristics.

It is therefore clear that the Cu-base shape-memory alloy of the present invention having these improved characteristics will ensure high reliability in its commercial application.

What is claimed is:

1. A Cu-base shape-memory alloy consisting essentially of 10–45% Zn, 1–10% Al, an intermetallic compound of Ti-Fe or Ti-Ni and wherein said alloy contains 0.05–2% of said Ti and 0.05–2% of said Fe or Ni, the balance of said alloy being Cu and incidental impurities, the percents being by weight.

2. A Cu-base shape-memory alloy consisting essentially of 10–45% Zn, 1–10% Al, 0.05–2% Ti, 0.05–2% of Fe, the balance being Cu and incidental impurities, the percent being by weight.

3. A Cu-base shape-memory alloy consisting essentially of 10–45% Zn, 1–10% Al, 0.05–2% Ti, 0.05–2% of Ni, the balance being Cu and incidental impurities, the percent being by weight.

* * * * *